US005408219A

United States Patent [19]

Newman et al.

[11] Patent Number: 5,408,219

[45] Date of Patent: Apr. 18, 1995

[54] FENCE GATE CONNECTOR FOR A PERIMETER SECURITY SYSTEM

[75] Inventors: Fredric Newman, Farmington Hills; William K. Proden, Highland, both of Mich.

[73] Assignee: Assessment & Control International, Inc., Bloomfield Hills, Mich.

[21] Appl. No.: 198,341

[22] Filed: Feb. 18, 1994

[51] Int. Cl.[6] ..... G08B 13/08

[52] U.S. Cl. ..... 340/545; 439/378; 439/917

[58] Field of Search ..... 340/545, 533; 439/917, 439/378, 374, 246, 32, 569

[56] References Cited

U.S. PATENT DOCUMENTS

| | | | |
|---|---|---|---|
| 3,636,484 | 1/1972 | Lea | 340/545 |
| 4,227,766 | 10/1980 | Finale | 340/545 |
| 4,556,765 | 12/1985 | Shaw et al. | 340/545 |
| 5,125,849 | 6/1992 | Briggs et al. | 439/378 |
| 5,243,325 | 9/1993 | Marin et al. | 340/545 |

*Primary Examiner*—Glen Swann

*Attorney, Agent, or Firm*—Barnes, Kisselle, Raisch, Choate, Whittemore & Hulbert

[57] ABSTRACT

A perimeter security system that includes a perimeter enclosure having a moving portal closure, a plurality of electronic sensors on the enclosure and a security system with conductors for electrically connecting the sensors in series to detect a security branch at one or more of the sensors. A connector arrangement for making series connection between the sensors across the closure when closed includes a pair of connector bodies for mounting at juxtaposed positions on an edge of the closure and on an edge of the enclosure opposed to the closure edge. Male and female electrical contacts are disposed on the connector bodies and connected to the security system for mating engagement when the closure is closed and disengagement when the closure is open. Cam fingers on one of the connector bodies and cam guides on the other connector body automatically align the bodies and the electrical contacts as the closure is closed. In this way, the electrical contacts mate with each other without jamming or damage as the closure is closed.

10 Claims, 2 Drawing Sheets

FENCE GATE CONNECTOR FOR A PERIMETER SECURITY SYSTEM

The present invention is directed to a gate connector, and more particularly to a connector for mating engagement of conductors across a gate or other sliding portal in a perimeter security system.

BACKGROUND AND SUMMARY OF THE INVENTION

There is a need in the art for a connector to make electrical connection across a gate. For example, in perimeter security systems of a type that include a perimeter enclosure such as a wall or fence, and a gate or door of the type that opens and closes in the direction of its plane, there is a need for a connector arrangement at the opposed edges of the gate and perimeter for making electrical connection of the security system conductors when the gate is closed. A general object of the present invention is to provide such a connector that is easy to install, that is rugged and weather-resistant, that is reliable and maintenance-free over an extended operating lifetime, and that is adapted for use in conjunction with most or all perimeter security systems.

A perimeter security system in accordance with the preferred implementation of the present invention includes a perimeter enclosure having a movable portal closure (e.g., a gate), a plurality of electronic sensors on the enclosure and a security system with conductors for electrically connecting the sensors to detect a security alarm at one or more of the sensors. A connector arrangement for making connection between the sensors across the gate when closed includes a pair of connector bodies for mounting at juxtapose positions on an edge of the gate and at fixed position on an edge of the enclosure opposed to the gate edge. Male and female electrical contacts are disposed on the connector bodies and connected to the security system for mating engagement when the gate is closed and disengagement when the gate is open. Cam fingers on one of the bodies and cam guides on the other body automatically align the bodies and the electrical contacts as the gate is closed. In this way, the electrical contacts mate with each other without jamming or damage as the gate is opened and closed.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF THE PREFERRED EMBODIMENT

Figure 1:
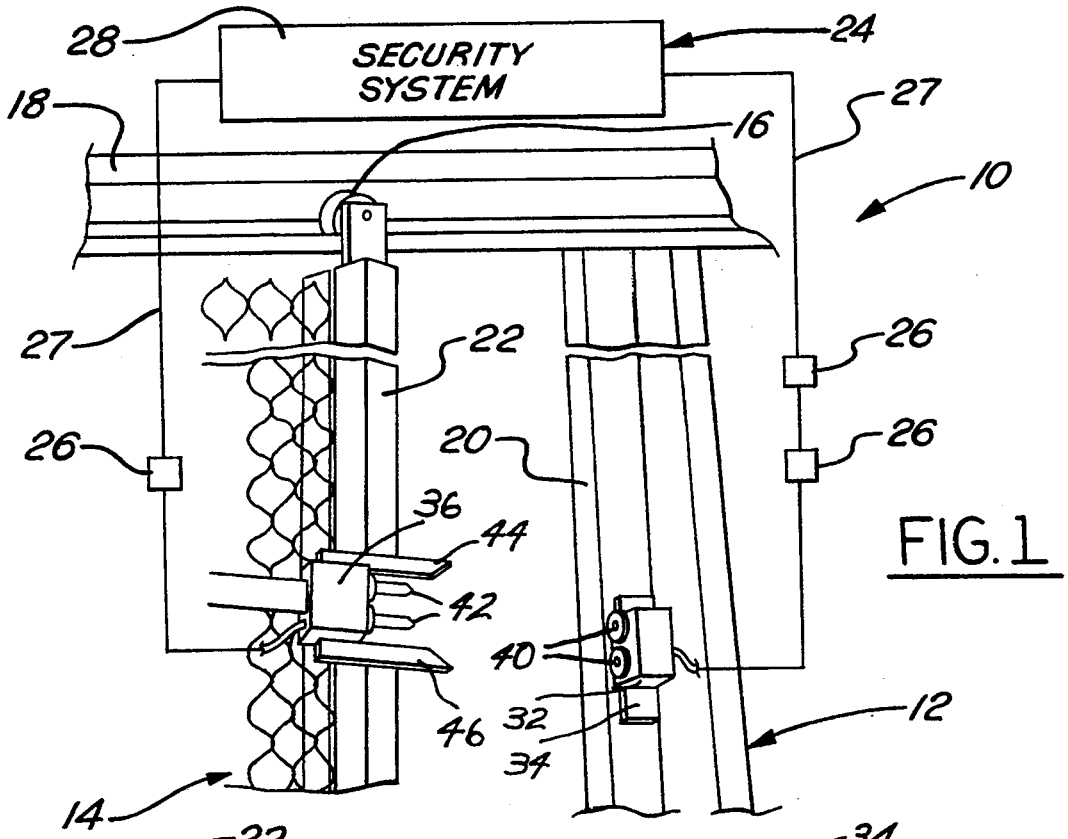
FIG. 1 is a fragmentary schematic diagram of a perimeter security system that includes a gate connector arrangement in accordance with a presently preferred embodiment of the invention.

FIG. 1 illustrates a perimeter security system 10 in accordance with the present invention as comprising a perimeter enclosure or fence 12 having a gate 14 carried by rollers 16 on an overhead track 18 for opening and closing in the direction of the plane of the gate. Fence 12 and gate 14 have opposed edge posts 20,22 that are adjacent and opposed to each other in the closed position of gate 14, and are spaced from each other as gate 14 opens and closes. It will be appreciated as the description unfolds that the subject matter of the present invention is by no means limited to link-type fences or gates, but has equal application for example in conjunction with a building perimeter wall enclosure and a gate or door mounted to move in the direction of its plane to open and close a portal in the wall.

A security system 24 includes a plurality of intrusion sensors 26 adapted to be electrically connected in series or parallel with each other in a closed loop 27 to a central electronic console 28. Some of the sensors 26 are mounted in fixed position on the enclosure fence 12 at spaced positions around the perimeter, while at least one sensor 26 is typically mounted on gate 14. Security system 24 including sensors 26 may be of any of the usual type for sensing an apparent intrusion or breach of security at the perimeter by vibration or other activity at the associated sensor. Typically, console 28 includes facility not only for identifying a security breach response to activation of one of the sensors 26, but also for identifying the area or zone at which security is breached by identifying the sensor or sensors 26 that have been activated. To the extent thus far described, security system 10 is of generally conventional construction.

Figure 4:
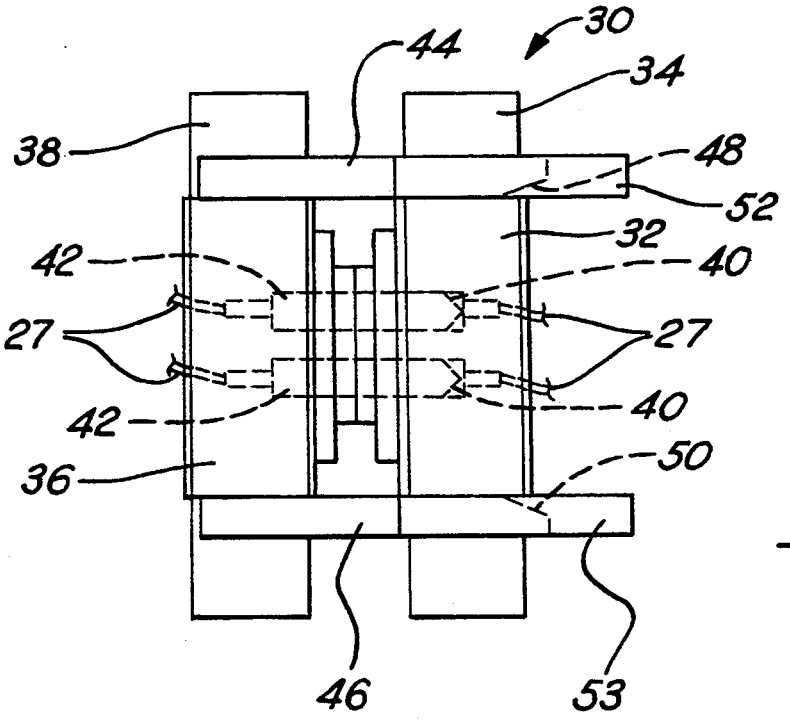
FIG. 4 is an elevational view of the connector arrangement in the closed condition.

In accordance with the present invention, a connector arrangement 30 is provided at opposed edge posts 20,22 for mating engagement with each other when gate 14 is closed, and thereby completing connection of sensors 26 in closed loop 27. Connector arrangement 30 comprises a first rectangular connector body 32 having a mounting plate 34 along one side face for mounting body 32 in fixed position on gate post 20. A second rectangular connector body 36 has a plate 38 along one side face for mounting body 36 in fixed position on gate post 22 at a location for juxtaposed mating engagement with connector body 32 when gate 14 is closed, as shown in FIG. 4. Connector body 32 carries one or more (depending upon the number of conductors in loop 27) female electrical contact elements 40. Similarly, connector body 36 carries one or more (again depending upon the number of conductors in loop 27) male electrical contact elements 42 of a type adapted for mating engagement with contacts 40 on connector body 32. Contacts 40,42 are of any suitable conventional type, preferably being of rugged weather-resistant construction such as gold-plated beryllium.

Figure 2:
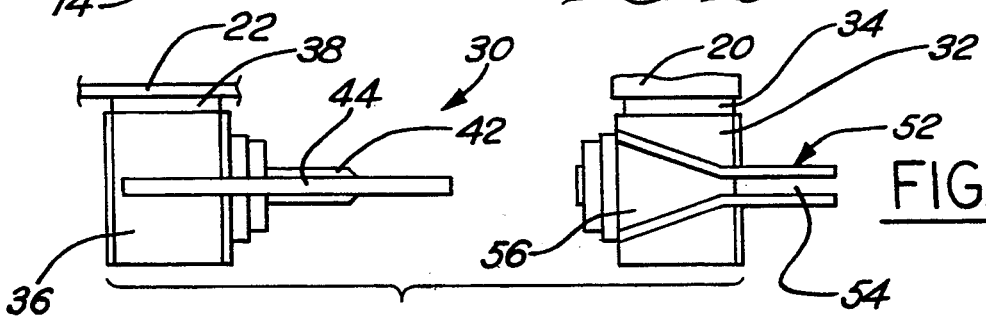
FIG. 2 is an exploded plan view of the connector arrangement in the open condition of FIG. 1.
Figure 3:
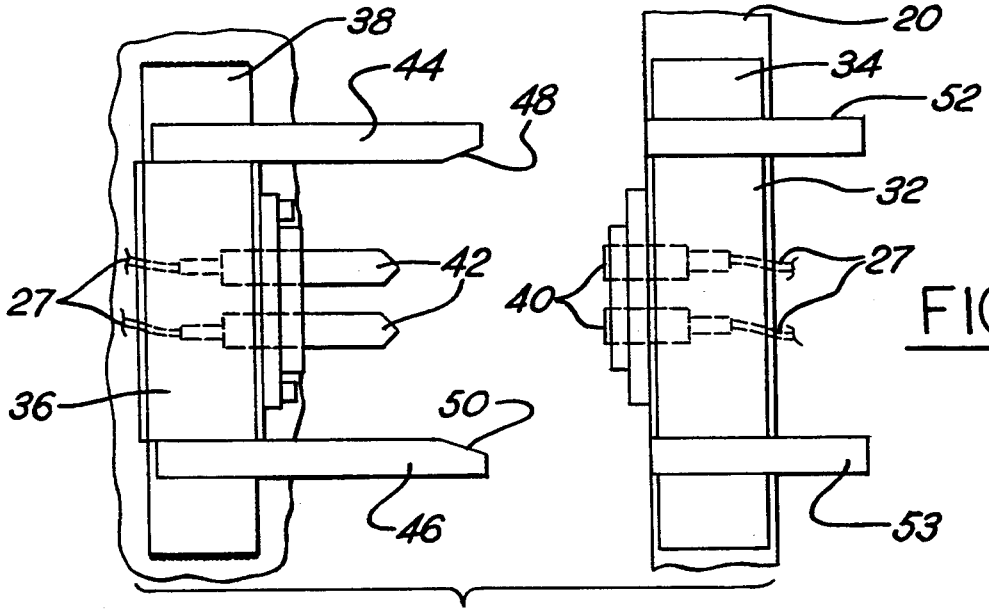
FIG. 3 is an exploded elevational view of the connector arrangement in the open condition of FIGS. 1 and 2.

A pair of cam fingers 44,46 extend from the top and bottom edges of connector body 36. Fingers 44,46 are of steel plate construction rigidly and permanently secured on edge to the opposing end of the connector body also of steel construction, with the fingers being parallel and coplanar with each other. Each finger 44,46 has angled camming surface 48,50 at the free end thereof, with the surfaces 48,50 being opposed to each other as best seen in FIG. 3. A pair of cam guides 52,53 are mounted at the opposed upper and lower ends of connector body 32. As best seen in FIG. 2, cam guide 52 comprises a pair of steel elements permanently secured to body 32 (also of steel construction) so as to form a channel 54 dimensioned to receive cam finger 44. The forward edge or opening of channel 54 is widened or enlarged at 56 so as to receive the free end of finger 44 and guide the same into the narrower portion of channel 54. Cam guide 53 at the lower end of connector body 32 is identical to and coplanar with guide 52 in FIG. 2. Male contacts 42 on connector body 36 are coplanar with guide fingers 44. Female contacts 40 on connector body 32 are coplanar with cam guide channels 54.

In operation, as gate 14 is closed and post 22 moves toward post 20, the free ends of cam fingers 44,46 on connector body 36 first engage cam guides 52,53 on connector body 32. In the event that connector body 36 on the gate is horizontally misaligned with connector body 32—i.e., laterally misaligned in FIG. 2—one or both of the fingers 44,46 engage the sides of channel openings 56 and thereby bring the cam fingers and cam guides, and thus the electrical contacts, into horizontal alignment. In the event that connector body 36 is vertically misaligned with connector body 32, one of the surfaces 48,50 on fingers 44,46 engage the opposing edge of connector body 32 as the fingers move into cam guide channel openings 56, so as to align electrical contact elements 40,42 with respect to each other in the vertical direction. Preferably, fingers 44,46 are dimensioned in coordination with cam guide channels 52,53 so as to align the connector bodies and contact elements 40,42 before the contact elements mate with each other. In this way, any stresses associated with alignment of the connector bodies are absorbed by the cam fingers, guide channels and connector bodies, leaving the relatively less rugged electrical contact elements substantially stress free upon mating engagement.

Preferably, male contacts 42 are mounted on the same connector body 36 as are fingers 44,46, so that the cam fingers provide an element of protection to the male contact members. Male contacts 42 may be mounted on connector body 32, and female contacts 40 on connector body 36, without affecting operation of connector arrangement 30, although the male contacts would then be exposed to potential damage when the gate is open.

We claim:

1. A connector arrangement for making connection across a movable portal closure when closed, said connector arrangement comprising:

a pair of connector bodies having means for mounting said bodies at juxtaposed positions on an edge of said closure and at a fixed position opposed to said closure edge, male and female electrical connector means on said bodies for mating engagement when said closure is closed and said closure edge is to adjacent to said fixed position, and for disengagement as said closure is opened and said closure edge moves away from said fixed position, and cam means on said bodies for automatically aligning said bodies and said electrical connector means as said closure is closed and said closure edge is moved toward said fixed position.

2. The arrangement set forth in claim 1 wherein said cam means comprises a cam finger extending from one of said bodies, and cam guide means on the other of said bodies for receiving said cam finger and aligning said bodies and connector means.

3. The arrangement set forth in claim 2 wherein said cam finger has an angled edge at a free end of said finger opposed to said other body.

4. The arrangement set forth in claim 2 wherein said cam guide means comprises means forming a channel to receive said finger.

5. The arrangement set forth in claim 4 wherein said channel-forming means comprises means forming an enlarged channel opening opposed to said finger for receiving said finger and aligning said finger with said channel.

6. The arrangement set forth in claim 5 wherein said cam means further comprises a second cam finger on said one body, said cam fingers being at upper and lower ends of said one body, and second cam guide means on said other body for receiving said second cam finger.

7. The arrangement set forth in claim 6 wherein said cam fingers have angled edges at the free ends thereof opposed to each other and to said other body.

8. The arrangement set forth in claim 7 wherein said cam fingers and said cam guide means are constructed and arranged such that said fingers are aligned with and enter said channels before mating engagement of said electrical connector means.

9. The arrangement set forth in claim 8 wherein said fingers are on the one of said bodies that carries the male electrical connector means.

10. In a perimeter security system that includes a perimeter enclosure having a movable portal closure, a plurality of electronic sensors on said enclosure and means for electrically connecting said sensors in series to detect a security branch at one or more of said sensors, a connector arrangement for making connection between said sensors across said portal closure when closed, said connector arrangement comprising:

a pair of connector bodies having means for mounting said bodies at juxtaposed positions on an edge of said closure and at a fixed position on an edge of said enclosure opposed to said closure edge, male and female electrical connector means on said bodies for mating engagement when said closure is closed and said closure edge is adjacent to said enclosure edge, and for disengagement as said closure is opened and said closure edge moves away from said enclosure edge, and cam means on said bodies for automatically aligning said bodies and said electrical connector means as said closure is closed and said closure edge is moved toward said enclosure edge.

* * * * *